US011583148B1

(12) United States Patent
Berry

(10) Patent No.: US 11,583,148 B1
(45) Date of Patent: Feb. 21, 2023

(54) TOILET DEVICE CONFIGURED TO PROVIDE A SELF-RISING TOILET SEAT AND METHOD OF USE THEREOF

(71) Applicant: Richard Alan Berry, Roswell, GA (US)

(72) Inventor: Richard Alan Berry, Roswell, GA (US)

( * ) Notice: Subject to any disclaimer, the term of this patent is extended or adjusted under 35 U.S.C. 154(b) by 0 days.

(21) Appl. No.: 17/524,538

(22) Filed: Nov. 11, 2021

(51) Int. Cl.
*A47K 13/10* (2006.01)

(52) U.S. Cl.
CPC ..... *A47K 13/10* (2013.01)

(58) Field of Classification Search
CPC ..... A47K 13/10
USPC ..... 4/246.1
See application file for complete search history.

(56) References Cited

U.S. PATENT DOCUMENTS

| | | | | |
|---|---|---|---|---|
| 1,681,277 | A | 8/1928 | Booth | |
| 2,812,522 | A | 11/1957 | Wilson | |
| 2,814,049 | A | 11/1957 | Mercur | |
| 2,877,469 | A | 3/1959 | Johnson | |
| 4,402,092 | A | 9/1983 | Smallwood | |
| 4,426,743 | A * | 1/1984 | Seabrooke | A47K 13/10 4/246.3 |
| 4,428,083 | A | 1/1984 | Chuang | |
| 4,780,914 | A | 11/1988 | Lin | |
| 4,817,242 | A | 4/1989 | Rapp | |
| 4,965,890 | A | 10/1990 | Fischer | |
| 5,379,465 | A | 1/1995 | Vaughn | |
| 5,642,532 | A | 7/1997 | Morant | |
| 6,012,180 | A | 1/2000 | Williams | |
| 6,510,562 | B1 | 1/2003 | Bae | |
| 6,684,416 | B1 | 2/2004 | Chao et al. | |
| 8,006,323 | B1 | 8/2011 | Potter | |
| 8,479,323 | B2 | 7/2013 | Blum | |
| 9,003,573 | B2 | 4/2015 | Erman | |
| 10,602,891 | B1 | 3/2020 | Kislin | |
| 11,213,175 | B1 * | 1/2022 | Wise | A47K 13/10 |
| 2007/0192949 | A1 | 8/2007 | Pan et al. | |
| 2008/0178372 | A1 | 7/2008 | Matalon | |
| 2013/0117918 | A1 | 5/2013 | Tian | |
| 2014/0189947 | A1 * | 7/2014 | Murphy | A47K 13/12 4/240 |

(Continued)

FOREIGN PATENT DOCUMENTS

| | | |
|---|---|---|
| DE | 20216128 | 1/2003 |
| DE | 102010033469 | 12/2011 |
| FR | 2302393 | 9/1976 |

(Continued)

*Primary Examiner* — Christine J Skubinna
(74) *Attorney, Agent, or Firm* — Jeffrey C. Watson; Grell & Watson Patent Attorneys LLC

(57) ABSTRACT

A toilet device is configured to provide a self-rising toilet seat on a toilet. The toilet device includes a base, at least one raising arm, and a force mechanism. The base is configured to attach to the toilet. The at least one raising arm is in communication with the self-rising toilet seat. Each of the at least one raising arms is rotatably connected to the base, where the at least one raising arm is configured to rotate about the base for raising the self-rising toilet seat. The force mechanism is operatively connected to the at least one raising arm. The force mechanism is configured to control the at least one raising arm to move to a raised position of the self-rising toilet seat.

17 Claims, 6 Drawing Sheets

(56) References Cited

U.S. PATENT DOCUMENTS

2018/0084958 A1* 3/2018 Lawhon ..... A47K 13/10

FOREIGN PATENT DOCUMENTS

| | | |
|---|---|---|
| JP | 2019180842 | 10/2019 |
| JP | 2019180843 | 10/2019 |
| JP | 2019180845 | 10/2019 |
| WO | 2017065814 | 4/2017 |

* cited by examiner

TOILET DEVICE CONFIGURED TO PROVIDE A SELF-RISING TOILET SEAT AND METHOD OF USE THEREOF

FIELD OF THE DISCLOSURE

The present disclosure is related to toilets, toilet seats for such toilets, and means, mechanisms and/or methods for raising such toilet seats. More specifically, the present disclosure is directed to a toilet device configured to provide a self-rising toilet seat and method of use thereof.

BACKGROUND

Generally speaking, a toilet is a piece of sanitary hardware that collects human urine and feces, and sometimes toilet paper, usually for disposal. Flush toilets use water, while dry or non-flush toilets do not. They can be designed for a sitting position popular in Europe and North America with a toilet seat, with additional considerations for those with disabilities. Toilets are commonly made of ceramic (porcelain), concrete, plastic, or wood. The technology used for modern toilets varies. Newer toilet technologies include dual flushing, automatic flushing with sensors, low flushing, toilet seat warming, self-cleaning, female urinals and waterless urinals.

A toilet seat is a hinged unit consisting of a round or oval open seat, and usually a lid, which is bolted onto the bowl of a toilet used in a sitting position (as opposed to a squat toilet). The seat can be either for a flush toilet or a dry toilet. A toilet seat consists of the seat itself, which may be contoured for the user to sit on, and the lid, which covers the toilet when it is not in use. The lid may be absent in some cases, particularly in public restrooms. The issue of whether the seat and lid should be placed in the closed position after use is a perennial topic of discussion and light humor (usually across gender lines), with it often being argued that leaving the toilet seat up is more efficient for men, while putting it down is more considerate for women. The "right answer" seems to depend on factors ranging from the location of the toilet (public or private), the population of the users (e.g. a sorority house vs frat house) and/or personal or family values, opinions, preferences, agreements or toiletry habits.

However, in most public restrooms, the toilet seat is typically kept in a down position when a toilet is not in use, making it so, a male should raise the toilet seat to urinate in the standing position. As such, a male must raise the toilet seat prior to urinating in a standing position. However, this standard may not always be followed in public restrooms, as males may not want to touch the toilet seat to raise it prior to urinating. This issue may lead to toilet seats being inoperable to sit on as their top sides become saturated with urine. As such, there is clearly a need to provide a means for raising a toilet seat, especially in commercial or public restroom settings.

The instant disclosure may be designed to address at least certain aspects of the problems or needs discussed above by providing a toilet device configured to provide a self-rising toilet seat and method of use thereof.

SUMMARY

The present disclosure may solve the aforementioned limitations of the currently available toilets, toilet seats, and means for raising such toilet seats, by providing the disclosed toilet device configured to provide a self-rising toilet seat and method of use thereof. As such, the disclosed toilet device may be configured to provide a self-rising toilet seat on a toilet. The toilet device may generally include a base, at least one raising arm, and a force mechanism. The base may be configured to attach to the toilet. The at least one raising arm may be in communication with the self-rising toilet seat. Each of the at least one raising arms may be rotatably connected to the base, where the at least one raising arm may be configured to rotate about the base for raising the self-rising toilet seat. The force mechanism may be operatively connected to the at least one raising arm. The force mechanism may be configured to control the at least one raising arm to move to a raised position of the self-rising toilet seat.

One feature of the disclosed toilet device configured to provide a self-rising toilet seat may be that the toilet device can be configured to self-raise the self-rising toilet seat from a seated position to the raised position.

Another feature of the disclosed toilet device configured to provide a self-rising toilet seat may be that the toilet device can be configured to maintain the self-rising toilet seat in the raised position until a lowering force is applied to move the self-rising toilet seat to the seated position.

In select embodiments of the disclosed toilet device configured to provide a self-rising toilet seat, the force mechanism may include a spring device. The spring device may be configured to provide a bias to the at least one raising arm to move to the raised position of the self-rising toilet seat. The spring device may include at least one spring that can be configured to provide the bias to the at least one raising arm to move to the raised position of the self-rising toilet seat. In select embodiments of the spring device, at least two springs may be included in a parallel configuration configured to provide the bias to the at least one raising arm to move to the raised position of the self-rising toilet seat. As an example, and clearly not limited thereto, in select possibly preferred embodiments, the spring device may include five springs in the parallel configuration. The spring device may include a housing with a plurality of channels therein. Each channel in the housing of the spring device may be configured to hold one of the springs therein. As an example, and clearly not limited thereto, in select possibly preferred embodiments, the spring device may include five springs in the parallel configuration, and a housing with five channels, where each of the five channels is configured to hold one of the five springs therein.

In select embodiments of the disclosed toilet device configured to provide a self-rising toilet seat, each of the at least one raising arms may include a mounting hole, a first arm portion, and a second arm portion. The mounting hole may be configured to receive a hinge pin of a toilet seat hinge therethrough. The first arm portion may extend away from the mounting hole in a first direction. The first arm portion may be configured to support the self-rising toilet seat for raising it from a seated position to the raised position. The second arm portion may extend away from the mounting hole in a second direction. The second arm portion may be configured to be operatively connected to the force mechanism to control the first arm portion to move to the raised position of the self-rising toilet seat. In select embodiments, the second direction may be approximately perpendicular to the first direction. In other select embodiments, the first arm portion may include a protective cover configured to engage a bottom of the self-rising toilet seat for dampening forces between the bottom of the self-rising toilet seat and the first arm portion. In other select embodiments, the second arm portion may include a controller rod affixed thereto. The controller rod may be affixed to the second arm portion at approximately a distal end of the second arm portion. The controller rod may be configured to engage the force mechanism to control the first arm portion to move to the raised position of the self-rising toilet seat. The base may include a rounded passageway configured to allow the controller rod to be moved therein from the seated position to the raised position of the self-rising toilet seat. In select possibly preferred embodiments, the at least one raising arm may include two raising arms. The two raising arms may include a first raising arm on a first side of the base, and a second raising arm on a second side of the base. The controller rod may be affixed between approximately a first distal end of the first raising arm and approximately a second distal end of the second raising arm. Wherein, the controller rod may be positioned through the rounded passageway of the base from the first side of the base to the second side of the base. In select embodiments, the force mechanism may include a sliding member configured to slide within the base. The sliding member may be configured to control the at least one raising arm to move to a raised position of the self-rising toilet seat via controlling the controller rod within the rounded passageway of the base. Wherein the force mechanism may include at least one spring configured to bias the at least one raising arm to the raised position of the self-rising toilet seat by biasing the sliding member to control the controller rod within the rounded passageway of the base.

Another feature of the disclosed toilet device configured to provide a self-rising toilet seat may be the inclusion of a disengaging mechanism. The disengaging mechanism may be configured to disengage the force mechanism from the at least one raising arm. Whereby the self-rising toilet seat may function as a normal toilet seat when the disengaging mechanism disengages the force mechanism from the at least one raising arm. In select embodiments, the disengaging mechanism may include an engaging nut and a lever. The engaging nut may have a rounded top portion and a flat bottom portion. The lever may be configured to rotate the engaging nut. The engaging nut may be operatively connected to a lip of the sliding member of the force mechanism. Wherein, when the lever is rotated in a self-rising direction to position the flat bottom portion down, the sliding member is free to move within the base and the force mechanism is configured to control the at least one raising arm to move to a raised position of the self-rising toilet seat. And when the lever is rotated in a disengaging opposite direction to position the rounded top portion down, the rounded top portion is configured to lock the sliding member in the seated position of the sliding member via the lip to prevent the force mechanism from controlling the at least one raising arm, whereby the self-rising toilet seat functions as the normal toilet seat.

Another feature of the disclosed toilet device configured to provide a self-rising toilet seat may be that the base can include a first notch and a second notch. The first notch of the base may be on a first side of the base. The first notch may be configured to receive a first toilet seat hinge. The second notch of the base may be on a second side of the base. The second notch may be configured to receive a second toilet seat hinge. Wherein, the base may be positioned and affixed to the toilet via the first toilet seat hinge being positioned and affixed in the first notch, and the second toilet seat hinge being positioned and affixed in the second notch.

In another aspect, the instant disclosure embraces the disclosed toilet device configured to provide a self-rising toilet seat in any embodiment and/or combination of embodiments shown and/or disclosed herein.

In another aspect, the instant disclosure embraces a toilet with the disclosed toilet device configured to provide a self-rising toilet seat in any embodiment and/or combination of embodiments shown and/or disclosed herein.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

Figure 1:
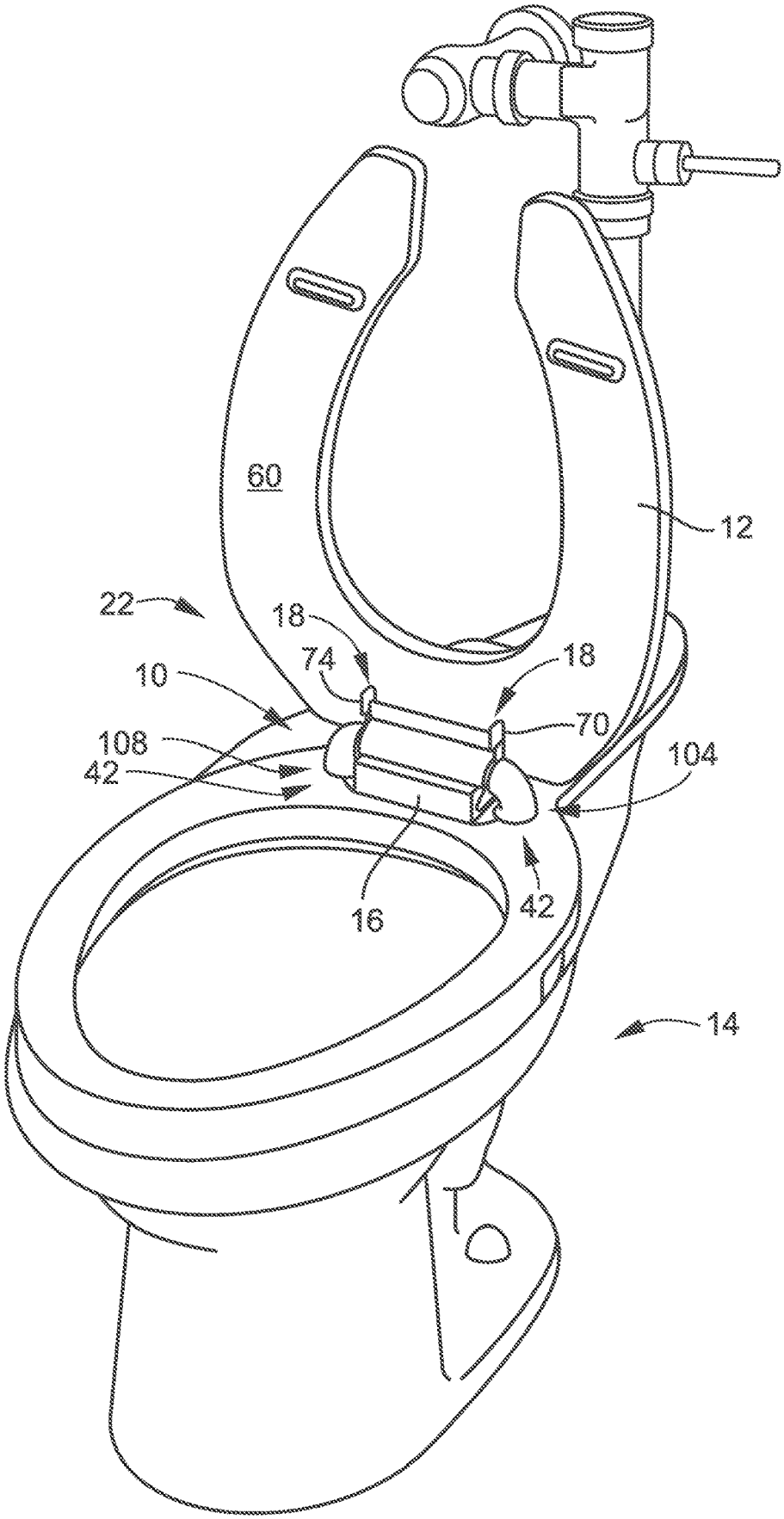
FIG. 1 is a perspective environmental view of the disclosed toilet device configured to provide a self-rising toilet seat according to select embodiments of the instant disclosure installed on a standard commercial toilet with or without a reservoir tank.
Figure 2:
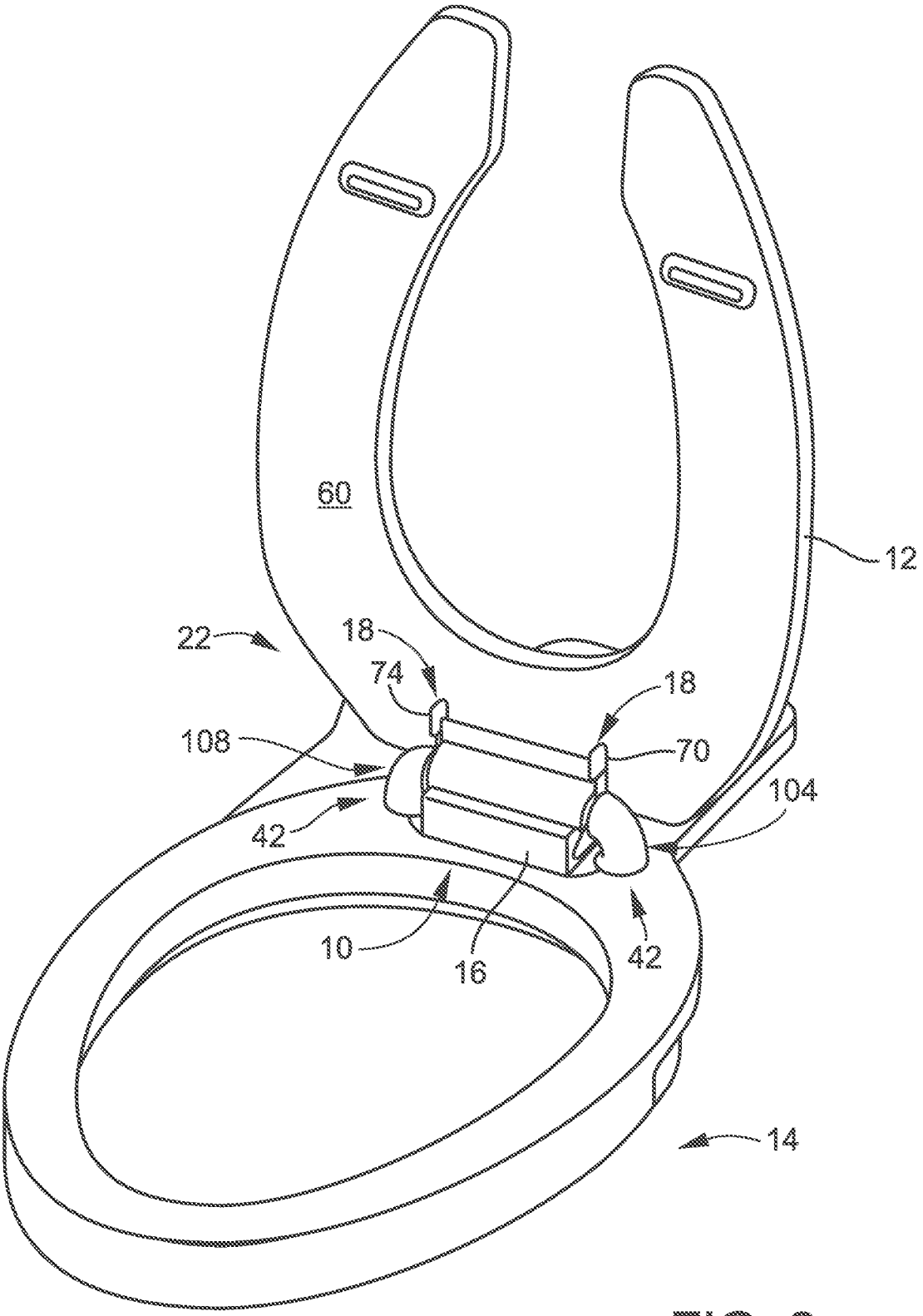
FIG. 2 is a perspective environmental view of the disclosed toilet device configured to provide a self-rising toilet seat according to select embodiments of the instant disclosure installed on a standard toilet bowl with or without a reservoir tank.
Figure 3:
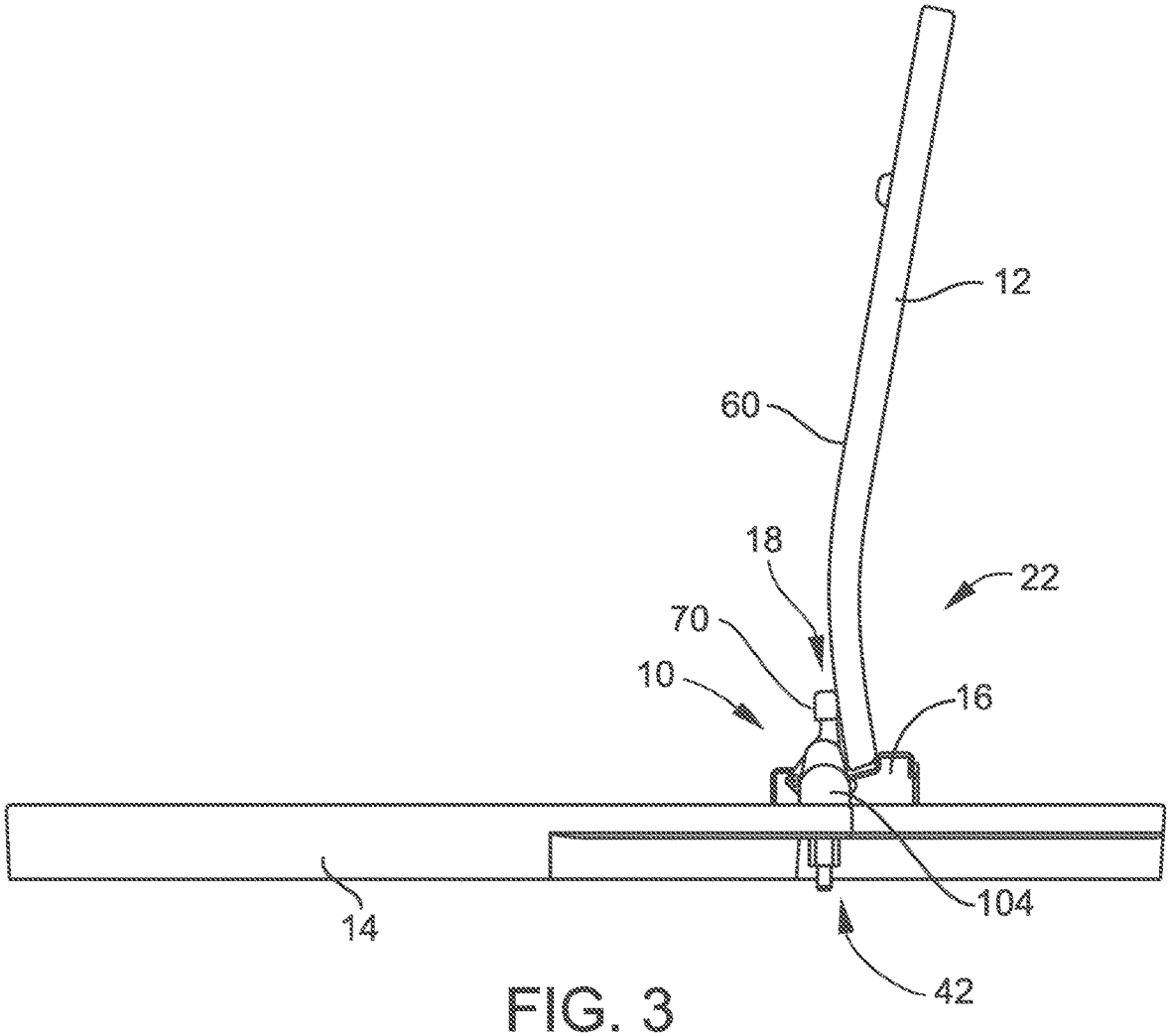
FIG. 3 is a side view of the toilet device configured to provide a self-rising toilet seat of FIG. 2 installed on a standard toilet bowl with the toilet seat in the raised position.
Figure 4:
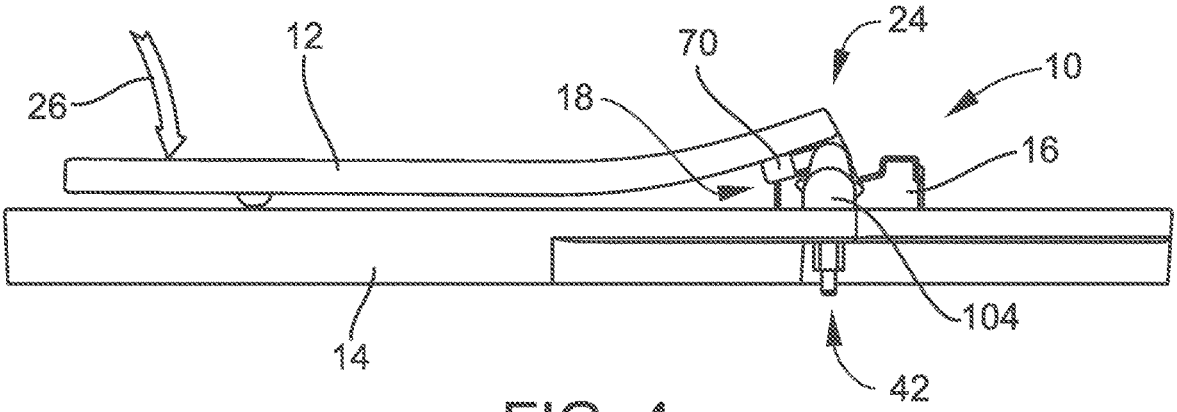
FIG. 4 is a side view of the toilet device configured to provide a self-rising toilet seat of FIG. 2 installed on a standard toilet bowl with the toilet seat in the seated position via lowering forces.
Figure 5:
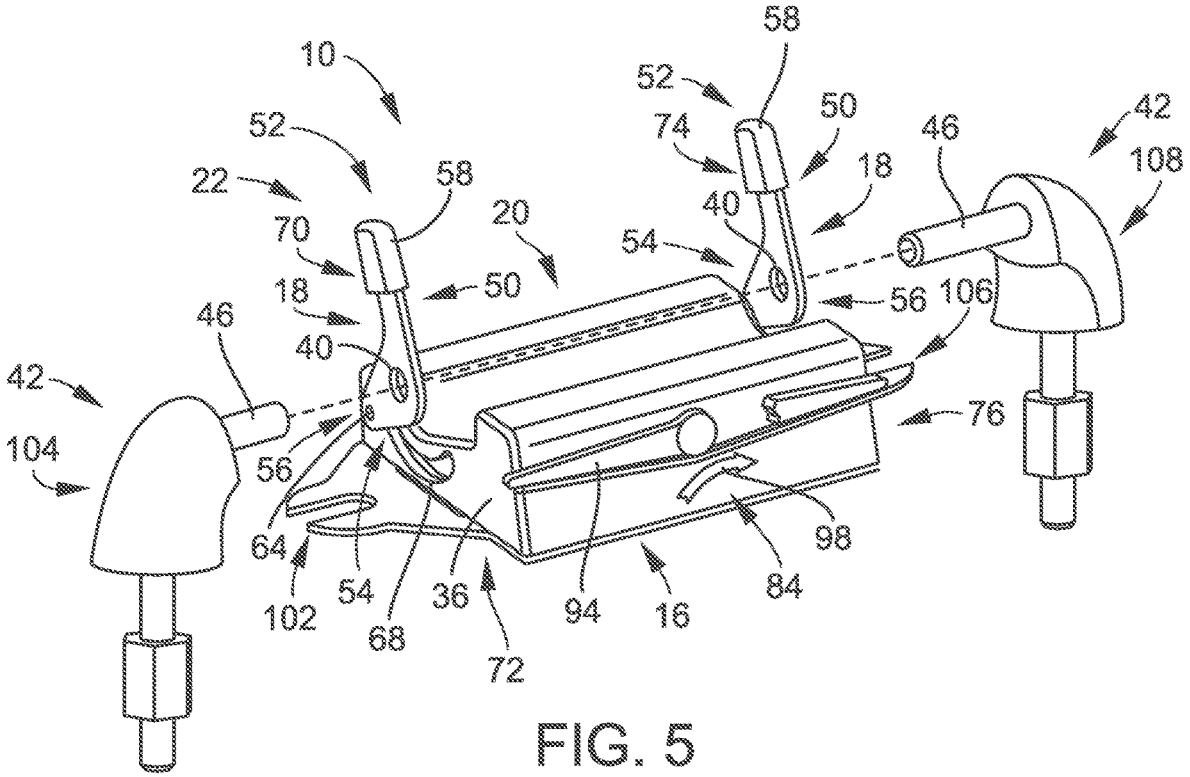
FIG. 5 is a rear perspective view of the toilet device configured to provide a self-rising toilet seat according to select embodiments of the instant disclosure showing how the device is installed with toilet hinges on both sides.
Figure 7:
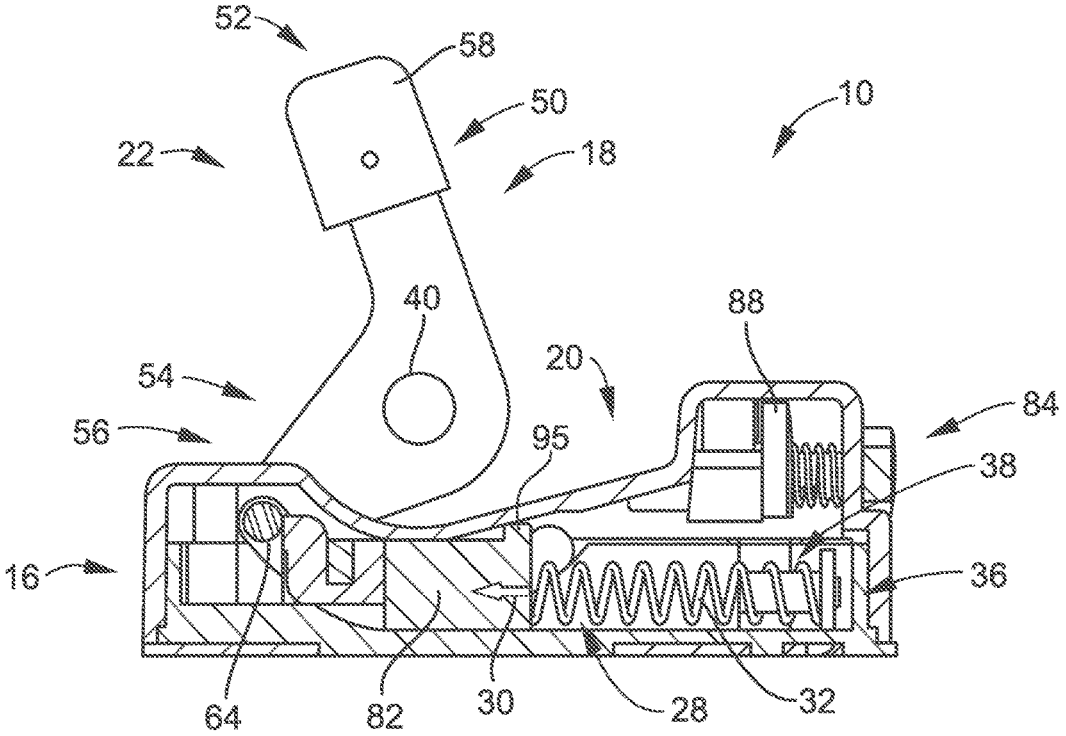
FIG. 7 is a cross-sectional side view of the toilet device configured to provide a self-rising toilet seat of FIG. 5 in the raised position showing the springs extended.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-12, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

The present disclosure may solve the aforementioned limitations of the currently available toilets, toilet seats, and means for raising such toilet seats, by providing toilet device 10 configured to provide self-rising toilet seat 12 and method of use thereof. As such, toilet device 10 may be configured to provide self-rising toilet seat 12 on toilet 14, as shown in FIGS. 1-4. Toilet device 10 may be installed on toilet 14, which may be any style or type of toilet, as either a part of a new toilet with self-rising toilet seat 12 or retrofitted on to any style or type of toilet, for retrofitting a standard toilet seat into self-rising toilet seat 12. Self-rising toilet seat 12 may be created with toilet device 10 installed thereon. Self-rising toilet seat 12 may be designed to be maintained at raised position 22 (see FIGS. 1-3) until an external force is applied to self-rising toilet seat 12 to move it down to seated position 24 (see FIG. 4). This external force may be a user's hand, foot, or other limb used to lower self-rising toilet seat 12 from raised position 22 down to seated position 24. Once lowered to seated position 24, the user may then sit on self-rising toilet seat 12 to maintain it in seated position 24. Once the user is finished sitting on self-rising toilet seat 12, they may stand up, whereby self-rising toilet seat 12 may automatically return to raised position 22. In other words, when no external forces are applied to self-rising toilet seat 12, self-rising toilet seat 12 may return to raised position 22 and be maintained at raised position 22. One feature of toilet device 10 configured to provide self-rising toilet seat 12 may be that toilet device 10 can be configured to self-raise self-rising toilet seat 12 from seated position 24 to raised position 22. Another feature of toilet device 10 configured to provide self-rising toilet seat 12 may be that toilet device 10 can be configured to maintain self-rising toilet seat 12 in raised position 22 until lowering force 26 (see FIG. 4) is applied to move self-rising toilet seat 12 to seated position 24. Toilet device 10 may generally include base 16, at least one raising arm 18, and force mechanism 20. These parts of toilet device 10 and their functions will be described in greater detail hereinafter.

Figure 6:
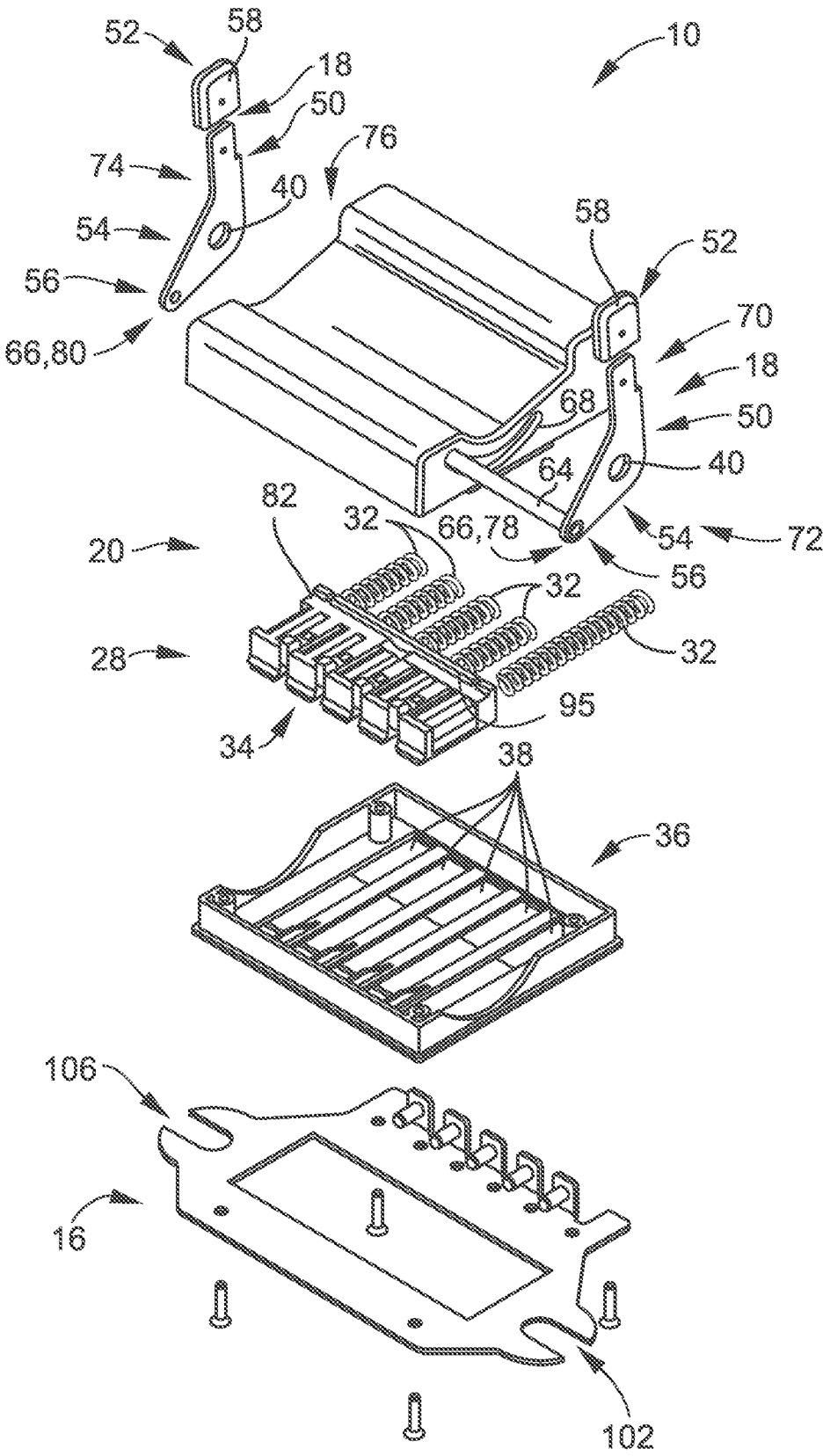
FIG. 6 is a partially disassembled front perspective view of the toilet device configured to provide a self-rising toilet seat of FIG. 5.
Figure 8:
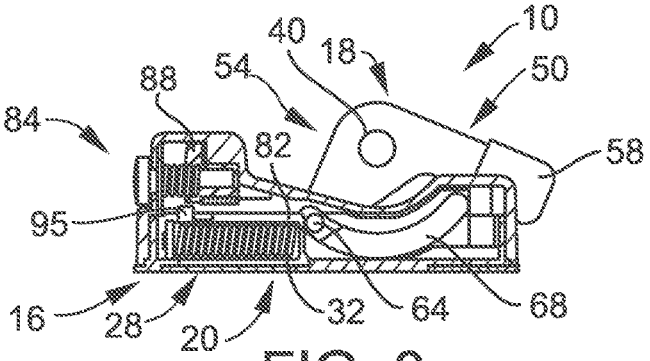
FIG. 8 is a cross-sectional side view of the toilet device configured to provide a self-rising toilet seat of FIG. 5 in the seated position showing the springs compressed.

Force mechanism 20 may be included with toilet device 10 configured for providing self-rising toilet seat 12. See FIGS. 6-7 and 8-12. Force mechanism 20 may be for providing the means or force required to raise and maintain self-rising toilet seat 12 at raised position 22. Force mechanism 20 may include any devices, means, and/or mechanisms configured for providing the means or force required to raise and maintain self-rising toilet seat 12 at raised position 22. Force mechanism 20 may be operatively connected to each raising arm 18. Force mechanism 20 may be configured to control each raising arm 18 to move to raised position 22 of self-rising toilet seat 12. In select embodiments of toilet device 10, and clearly not limited thereto, force mechanism 20 may include spring device 28, as shown in the Figures. Spring device 28 may be configured to provide bias 30 (see FIG. 7) to each of the raising arms 18 to move to raised position 22 of self-rising toilet seat 12. Spring device 28 may include at least one spring 32 that can be configured to provide bias 30 to each of the at least one raising arms 18 to move to raised position 22 of self-rising toilet seat 12. In select embodiments of spring device 28, at least two springs 32 may be included in parallel configuration 34 (see FIGS. 6 and 10) configured to provide bias 30 to each of the at least one raising arms 18 to move to raised position 22 of self-rising toilet seat 12. As an example, and clearly not limited thereto, in select possibly preferred embodiments, spring device 28 may include five springs 32 in parallel configuration 34, as shown in the Figures. Spring device 28 may include housing 36 with plurality of channels 38 therein. Each channel 38 in housing 36 of spring device 28 may be configured to hold one of the springs 32 therein. As an example, and clearly not limited thereto, in select possibly preferred embodiments, spring device 28 may include five springs 32 in parallel configuration 34, and housing 36 may have five channels 38, where each of the five channels 38 may be configured to hold one of the five springs 32 therein, as shown in FIGS. 6 and 10.

At least one raising arm 18 may be include with toilet device 10 configured for providing self-rising toilet seat 12. See FIGS. 1-12, best shown in FIGS. 5-7. The raising arm 18 or plurality of raising arms 18 may be for providing force to bottom 60 of self-rising toilet seat 12 to raise and maintain it at raised position 22. Raising arm 18 or plurality of raising arms 18 may include any configuration, device, or mechanisms configured for providing force to self-rising toilet seat 12 to raise and maintain it at raised position 22. As such, raising arm 18 or plurality of raising arms 18 may be in communication with self-rising toilet seat 12. Each of the at least one raising arms may be rotatably connected to base 16, where raising arm 18 or plurality of raising arms 18 may be configured to rotate about base 16 for raising self-rising toilet seat 12 to raised position 22. In select embodiments of toilet device 10, each of the at least one raising arms 18 may include mounting hole 40, first arm portion 50, and second arm portion 54. Mounting hole 40 may be configured to receive hinge pin 46 of toilet seat hinge 42 therethrough (see FIGS. 1-5, best shown in FIG. 5). First arm portion 50 may extend away from mounting hole 40 in first direction 52. First arm portion 50 may be configured to support self-rising toilet seat 12 for raising it from seated position 24 to raised position 22. Second arm portion 54 may extend away from mounting hole 40 in second direction 56. Second arm portion 54 may be configured to be operatively connected to force mechanism 20 to control first arm portion 50 to move to raised position 22 of self-rising toilet seat 12. In select embodiments, second direction 56 may be approximately perpendicular to first direction 52, to provide an L-shaped raising arm 18, as shown in the Figures. In other select embodiments, first arm portion 50 may include protective cover 58 configured to engage bottom 60 of self-rising toilet seat 12. Protective cover 58 may be configured for dampening forces and/or vibrations between bottom 60 of self-rising toilet seat 12 and first arm portion 50. Protective cover 58 may be any material designed and configured to dampen the forces and/or vibrations between bottom 60 of self-rising toilet seat 12 and first arm portion 50, including but not limited to, any silicone, soft plastic or rubber type materials, or the like. In other select embodiments, second arm portion 54 may include controller rod 64 affixed thereto (see FIGS. 5-8 and 11-12). Controller rod 64 may be affixed to second arm portion 54 at approximately distal end 66 of second arm portion 54. Controller rod 64 may be configured to engage force mechanism 20 to control first arm portion 50 to move to raised position 22 of self-rising toilet seat 12. Base 16 may include rounded passageway 68 (see FIGS. 5, 6, 8, and 10-12) configured to allow controller rod 64 to be moved therein from seated position 24 to raised position 22 of self-rising toilet seat 12.

As shown in the Figures, in select possibly preferred embodiments, the at least one raising arm 18 may include two raising arms 18. The two raising arms 18 may include first raising arm 70 on first side 72 of base 16, and second raising arm 74 on second side 76 of base 16. Controller rod 64 may be affixed between approximately first distal end 78 of first raising arm 70 and approximately second distal end 80 of second raising arm 74. Wherein, controller rod 64 may be positioned through rounded passageway 68 of base 16 from first side 72 of base 16 to second side 76 of base 16. In select embodiments, as shown in the Figures, force mechanism 20 may include sliding member 82 configured to slide within base 16. Sliding member 82 may be configured to control the at least one raising arm 18 to move to raised position 22 of self-rising toilet seat 12 seat via controlling controller rod 64 within rounded passageway 68 of base 16. Wherein, force mechanism 20 may include at least one spring 32 configured to bias the at least one raising arm 18 to raised position 22 of self-rising toilet seat 12 by biasing sliding member 82 to control controller rod 64 within rounded passageway 68 of base 16.

Figure 9:
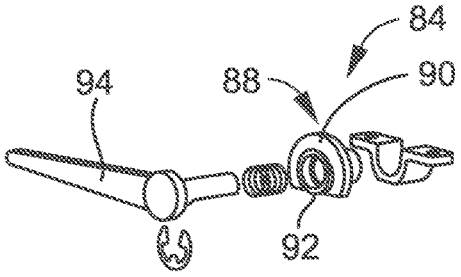
FIG. 9 is a rear perspective view of the lever of the disengaging mechanism partially disassembled from the toilet device configured to provide a self-rising toilet seat of FIG. 5.
Figure 10:
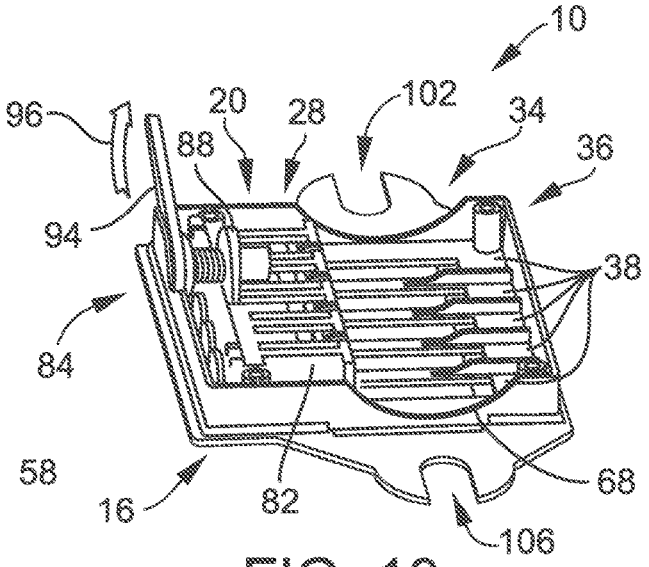
FIG. 10 is a partially disassembled top perspective view of the toilet device configured to provide a self-rising toilet seat of FIG. 5.
Figure 11:
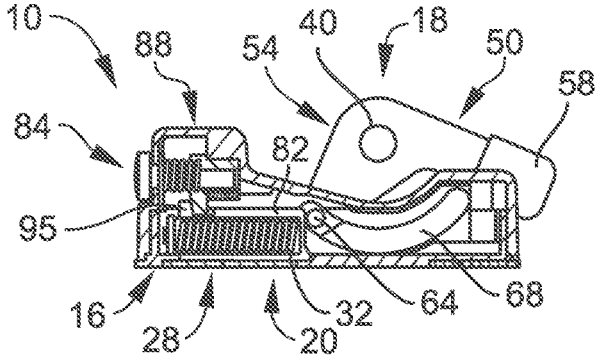
FIG. 11 is a cross-sectional side view of the toilet device configured to provide a self-rising toilet seat of FIG. 5 showing the lever rotated and the springs disengaged via the disengaging mechanism.
Figure 12:
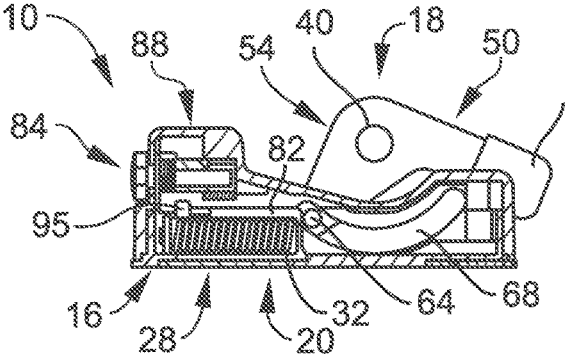
FIG. 12 a cross-sectional side view of the toilet device configured to provide a self-rising toilet seat of FIG. 5 showing the lever rotated to re-engage the springs via the disengaging mechanism.

Referring now specifically to FIGS. 5-12, another feature of toilet device 10 configured to provide self-rising toilet seat 12 may be the inclusion of disengaging mechanism 84. Disengaging mechanism 84 may be configured to disengage force mechanism 20 from the at least one raising arm 18. Whereby, self-rising toilet seat 12 may function as a normal toilet seat when disengaging mechanism disengages force mechanism 20 from the at least one raising arm 18. Disengaging mechanism 84 may include any device, means and/or mechanisms for disengaging force mechanism 20 from the raising arm 18 or plurality of raising arms 18. In select embodiments, as best shown in FIG. 9, disengaging mechanism 84 may include engaging nut 88 and lever 94. Engaging nut 88 may have rounded top portion 90 and flat bottom portion 92. Lever 94 may be configured to rotate engaging nut 88. Engaging nut 88 may be operatively connected to lip 95 on sliding member 82 of the force mechanism. Wherein, when lever 94 is rotated in self-rising direction 96 to position flat bottom portion 92 down, sliding member 82 is free to move within base 16 and force mechanism 20 is configured to control the at least one raising arm 18 to move to raised position 22 of self-rising toilet seat 12. And when lever 94 is rotated in disengaging opposite direction 98 to position the rounded top portion 90 down, rounded top portion 90 is configured to lock sliding member 82 in seated position 24 of the sliding member via lip 95 to prevent force mechanism 20 from controlling the at least one raising arm 18, whereby self-rising toilet seat 12 functions as the normal toilet seat. As shown in FIG. 9, lever 94 with engaging nut 88 may include a bracket to maintain it in position within base 16 and a spring for providing tension to engaging nut 88 to keep it in its desired position of disengaging mechanism 84.

Base 16 may be included with toilet device 10 configured for providing self-rising toilet seat 12. See FIGS. 1-12, best shown in FIGS. 6 and 10. Base 16 may be for providing the foundation of toilet device 10 that may be attached onto toilet 14. Base 16 may include any components and/or configurations configured for providing the foundation and/or means for attaching toilet device 10 to toilet 14. As such, base 16 may be configured to attach to toilet 14. Base 16 may be configured to attach toilet device 10 to toilet 14 by any means, mechanism and/or configuration, and may be designed to attach to any type, size, style of toilet 14, including but not limited to any residential toilets or any commercial toilets (as shown in the Figures). In select embodiments of toilet device 10 configured to provide self-rising toilet seat 12 seat, as shown in the Figures, base 16 can include first notch 102 and second notch 106. First notch 102 of base 16 may be on first side 72 of base 16. First notch 102 may be configured to receive first toilet seat hinge 104 therein. Second notch 106 of base 16 may be on second side 76 of base 16. Second notch 106 may be configured to receive second toilet seat hinge 108 therein. Wherein, base 16 may be positioned and affixed to toilet 14 via first toilet seat hinge 104 being positioned and affixed in first notch 102, and second toilet seat hinge 108 being positioned and affixed in second notch 106 (see FIGS. 1-2 and 5). First notch 102 and/or second notch 106 may be holes, notches, slots, the like, etc. configured to receive various desired toilet seat hinges.

In another aspect, the instant disclosure embraces toilet device 10 configured to provide self-rising toilet seat 12 in any embodiment and/or combination of embodiments shown and/or disclosed herein.

In another aspect, the instant disclosure embraces toilet 14 with toilet device 10 configured to provide self-rising toilet seat 12 in any embodiment and/or combination of embodiments shown and/or disclosed herein. Toilet 14 may include any size, type or style of a toilet including any size, type, or type of toilet seat and hardware, including any type of toilet seat hinge.

In sum, the disclosed toilet device 10 configured to provide self-rising toilet seat 12 and method of use thereof may be designed to provide a single self-contained unit that fits on a toilet and controls the seat to keep it raised until pushed down and then returns up when finished. A feature of the present disclosure may be its ability to keep the toilet seat up when not in use. Another feature of the present disclosure may be its ability to be disengaged if needed so the seat can act as a standard seat. Another feature of the present disclosure may be its ability to operate without power or adjustment by an outside force, i.e. it may be self-contained.

* * *

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. A toilet device configured to provide a self-rising toilet seat on a toilet, the toilet device comprising:

a base configured to attach to the toilet;

at least one raising arm in communication with the self-rising toilet seat, each of the at least one raising arms is rotatably connected to the base, where the at least one raising arm is configured to rotate about the base for raising the self-rising toilet seat;

a force mechanism operatively connected to the at least one raising arm, the force mechanism is configured to control the at least one raising arm to move to a raised position of the self-rising toilet seat;

wherein the force mechanism including a spring device configured to provide a bias to the at least one raising arm to move to the raised position of the self-rising toilet seat;

wherein the spring device including at least one spring configured to provide the bias to the at least one raising arm to move to the raised position of the self-rising toilet seat; and wherein the spring device including at least two springs in a parallel configuration configured to provide the bias to the at least one raising arm to move to the raised position of the self-rising toilet seat.

2. The toilet device according to claim 1, wherein the toilet device is configured to self-raise the self-rising toilet seat from a seated position to the raised position.

3. The toilet device according to claim 2, wherein the toilet device is configured to maintain the self-rising toilet seat in the raised position until a lowering force is applied to move the self-rising toilet seat to the seated position.

4. The toilet device according to claim 1, wherein the spring device including five springs in the parallel configuration.

5. The toilet device according to claim 1, wherein the spring device including a housing with a plurality of channels therein, each channel is configured to hold one of the at least two springs therein.

6. The toilet device according to claim 5, wherein the spring device including:

five springs in the parallel configuration; and five channels, each of the five channels is configured to hold one of the five springs therein.

7. The toilet device according to claim 1, wherein each of the at least one raising arms including:

a mounting hole therethrough, the mounting hole is configured to receive a hinge pin of a toilet seat hinge therethrough;

a first arm portion extending away from the mounting hole in a first direction, the first arm portion is configured to support the self-rising toilet seat for raising it from a seated position to the raised position; and a second arm portion extending away from the mounting hole in a second direction, the second arm portion is configured to be operatively connected to the force mechanism to control the first arm portion to move to the raised position of the self-rising toilet seat.

8. The toilet device according to claim 7, wherein:

the second direction is approximately perpendicular to the first direction; and the first arm portion including a protective cover configured to engage a bottom of the self-rising toilet seat for dampening forces between the bottom of the self-rising toilet seat and the first arm portion.

9. The toilet device according to claim 7, wherein the second arm portion including a controller rod affixed to approximately a distal end of the second arm portion, the controller rod is configured to engage the force mechanism to control the first arm portion to move to the raised position of the self-rising toilet seat; and wherein, the base including a rounded passageway configured to allow the controller rod to be moved therein from the seated position to the raised position of the self-rising toilet seat.

10. The toilet device according to claim 9, wherein the at least one raising arm including two raising arms, the two raising arms including:

a first raising arm on a first side of the base;

a second raising arm on a second side of the base; and wherein, the controller rod is affixed between approximately a first distal end of the first raising arm and approximately a second distal end of the second raising arm, wherein the controller rod is positioned through the rounded passageway of the base from the first side of the base to the second side of the base.

11. The toilet device according to claim 9, wherein the force mechanism including a sliding member configured to slide within the base, where the sliding member is configured to control the at least one raising arm to move to the raised position of the self-rising toilet seat via controlling the controller rod within the rounded passageway of the base.

12. The toilet device according to claim 11, wherein the force mechanism including at least one spring configured to bias the at least one raising arm to the raised position of the self-rising toilet seat by biasing the sliding member to control the controller rod within the rounded passageway of the base.

13. The toilet device according to claim 1 further including a disengaging mechanism, the disengaging mechanism is configured to disengage the force mechanism from the at least one raising arm, whereby the self-rising toilet seat functions as a normal toilet seat.

14. The toilet device according to claim 13, wherein the disengaging mechanism including:

an engaging nut with a rounded top portion and a flat bottom portion;

a lever configured to rotate the engaging nut;

the engaging nut is operatively connected to a lip of a sliding member of the force mechanism, wherein:

when the lever is rotated in a self-rising direction to position the flat bottom portion down, the sliding member is free to move within the base and the force mechanism is configured to control the at least one raising arm to move to the raised position of the self-rising toilet seat; and when the lever is rotated in a disengaging opposite direction to position the rounded top portion down, the rounded top portion is configured to lock the sliding member in a seated position of the sliding member via the lip to prevent the force mechanism from controlling the at least one raising arm, whereby the self-rising toilet seat functions as the normal toilet seat.

15. The toilet device according to claim 1, wherein the base including:

a first notch on a first side of the base, the first notch is configured to receive a first toilet seat hinge;

a second notch on a second side of the base, the second notch is configured to receive a second toilet seat hinge; and wherein, the base is positioned and affixed to the toilet via the first toilet seat hinge being positioned and affixed in the first notch, and the second toilet seat hinge being positioned and affixed in the second notch.

16. A toilet with a self-rising toilet seat, the toilet comprising:

a device configured to create the self-rising toilet seat, the device including:

a base configured to attach to the toilet;

at least one raising arm in communication with the self-rising toilet seat, each of the at least one raising arms is rotatably connected to the base, where the at least one raising arm is configured to rotate about the base for raising the self-rising toilet seat;

a force mechanism operatively connected to the at least one raising arm, the force mechanism is configured to control the at least one raising arm to move to a raised position of the self-rising toilet seat; and a disengaging mechanism, the disengaging mechanism is configured to disengage the force mechanism from the at least one raising arm, whereby the self-rising toilet seat functions as a normal toilet seat.

17. A toilet device configured to provide a self-rising toilet seat on a toilet, the toilet device comprising:

a base configured to attach to the toilet;

at least one raising arm in communication with the self-rising toilet seat, each of the at least one raising arms is rotatably connected to the base, where the at least one raising arm is configured to rotate about the base for raising the self-rising toilet seat, wherein each of the at least one raising arms including:

a mounting hole therethrough, the mounting hole is configured to receive a hinge pin of a toilet seat hinge therethrough;

a first arm portion extending away from the mounting hole in a first direction, the first arm portion is configured to support the self-rising toilet seat for raising it from a seated position to the raised position; and a second arm portion extending away from the mounting hole in a second direction, the second arm portion is configured to be operatively connected to the force mechanism to control the first arm portion to move to the raised position of the self-rising toilet seat; and a force mechanism operatively connected to the at least one raising arm, the force mechanism is configured to control the at least one raising arm to move to a raised position of the self-rising toilet seat.

* * * * *